US012559278B2

(12) United States Patent
Schwaiger

(10) Patent No.: US 12,559,278 B2
(45) Date of Patent: Feb. 24, 2026

(54) DEVICE FOR HANDLING CONTAINERS

(71) Applicant: HECHT Technologie GmbH, Pfaffenhofen/Ilm (DE)

(72) Inventor: Thomas Schwaiger, Pfaffenhofen/Ilm (DE)

(73) Assignee: HECHT TECHNOLOGIE GMBH, Pfaffenhofen/Ilm (DE)

( * ) Notice: Subject to any disclaimer, the term of this patent is extended or adjusted under 35 U.S.C. 154(b) by 0 days.

(21) Appl. No.: 18/817,591

(22) Filed: Aug. 28, 2024

(65) Prior Publication Data

US 2025/0074645 A1 Mar. 6, 2025

(30) Foreign Application Priority Data

Aug. 30, 2023 (DE) ..... 10 2023 123 373.4
Sep. 26, 2023 (DE) ..... 10 2023 126 131.2

(51) Int. Cl.
*B65B 43/46* (2006.01)
*B65B 43/26* (2006.01)

(52) U.S. Cl.
CPC ..... *B65B 43/265* (2013.01); *B65B 43/46* (2013.01)

(58) Field of Classification Search
CPC ..... B65B 43/265; B65B 43/46; B65B 55/022; B65B 55/027; B25J 21/00
See application file for complete search history.

(56) References Cited

U.S. PATENT DOCUMENTS

| | | | | |
|---|---|---|---|---|
| 4,530,202 | A * | 7/1985 | Powell | B67C 7/0073 141/90 |
| 9,649,769 | B2 | 5/2017 | Colin et al. | |
| 10,850,873 | B2 * | 12/2020 | Procyshyn | B65B 55/027 |
| 10,967,994 | B2 * | 4/2021 | Procyshyn | B65B 55/022 |
| 11,554,886 | B2 * | 1/2023 | Procyshyn | B65B 55/022 |
| 12,139,287 | B2 * | 11/2024 | Brom | B65B 7/28 |
| 2018/0037343 | A1 * | 2/2018 | Procyshyn | B65B 3/003 |
| 2020/0156812 | A1 * | 5/2020 | Procyshyn | B65B 55/022 |
| 2021/0070481 | A1 * | 3/2021 | Procyshyn | B65B 55/022 |
| 2022/0388702 | A1 * | 12/2022 | Brom | B65B 43/46 |
| 2023/0234734 | A1 * | 7/2023 | Boira | B25J 21/005 141/1 |

FOREIGN PATENT DOCUMENTS

| | | | | |
|---|---|---|---|---|
| DE | 102020110825 | A1 | 10/2021 | |
| EP | 3 493 783 | B1 | 3/2021 | |
| EP | 3878612 | A1 * | 9/2021 | B01L 3/527 |
| WO | 2015014428 | A1 | 2/2015 | |
| WO | WO-2021042217 | A1 * | 3/2021 | B65B 69/00 |

OTHER PUBLICATIONS

Extended European Search Report dated Jan. 27, 2025 for corresponding European Application No. 24196474.1.

* cited by examiner

*Primary Examiner* — Andrew M Tecco
(74) *Attorney, Agent, or Firm* — Chrisman Gallo Tochtrop LLC

(57) ABSTRACT

The application relates to a device for handling containers including: a robot device configured to operate an opening element provided on/in a container in such a way that the robot device has access to an interior space of the container via the opening element, and to subsequently fill and/or empty the container via the opening element.

7 Claims, 12 Drawing Sheets

DEVICE FOR HANDLING CONTAINERS

This application claims priority to German Patent Application 10 2023 123 373.4 filed Aug. 30, 2023 and German Patent Application 10 2023 126 131.2 filed Sep. 26, 2023, the entire disclosure of which is incorporated by reference herein.

The invention relates to a device for handling containers, in particular for emptying containers containing a bulk material and/or for filling the containers with a bulk material. The invention also relates to a corresponding accessory.

Patent publication WO 2015/104428 A1 describes an emptying device that is used in particular for emptying drums.

The emptying device shown comprises an isolator to which a drum to be emptied can be connected. Inside the isolator there is a delivery line with a suction pipe connected to it.

A user can manually operate the suction pipe via glove ports inside the isolator and insert it into the connected drum, wherein a pump arranged outside the isolator generates such a vacuum in the delivery line or suction pipe that the user can empty the drum.

The connection of the respective drum is carried out according to the state of the art by means of O-rings and inflatable seals, whereby the respective steps must be carried out manually by the user. The actual emptying is also carried out manually by the user. Both activities are time-consuming, laborious and therefore cost-intensive.

Against this background, it is the object of the invention to create a device and corresponding accessory which allow simplified handling of containers.

At least it is an object of the invention to obtain an alternative to the prior art.

These objects are solved by a device according to the invention as defined in patent claim 1.

The device according to the invention is used in particular for emptying containers containing a bulk material and/or for filling the containers with a bulk material, wherein the device comprises:

- a robot device configured (i) to operate an opening element provided on/in a container in such a way that the robot device has access to an interior space of the container via the opening element, and (ii) to subsequently fill and/or empty the container via the opening element.

The robot device is in particular an industrial robot with a robot arm (manipulator), a tool and/or gripper (effector) and a controller.

The robot arm is preferably designed so that it can move and deploy the tool and/or the gripper in three-dimensional space.

The controller is preferably configured in such a way that the desired movements of the robot arm can be programmed using a teach-in or playback procedure. The former involves moving to the desired positions using a console, whereas the latter involves the user guiding the robot arm directly to the desired positions. The coordinates obtained using both methods are stored by the controller so that they are available for extensive programming.

Alternatively, the robot device can be programmed using offline programming.

For example, the robot device is configured in such a way that it can use the effector to insert a conveyor line, which is used for filling and/or emptying the container, into the container via the opening element and pull it out again. The bulk material is preferably pneumatically sucked out of the container via the conveyor line (emptying) or fed into the container (filling). Alternatively, a screw conveyor can be arranged in the conveyor line to transport the bulk material.

Preferably, the device according to the invention further comprises: an isolator in which the robot device is arranged and to which the container can be connected via a docking portion in such a way that the opening element is accessible to the robot device.

The isolator ensures that the robot device is sealed off so that the container is emptied and/or filled without contamination.

Contamination-free means that neither the bulk material can escape from the isolator nor contaminating particles can enter the isolator. This means that a user who is outside the isolator cannot come into contact with the bulk material and, in addition, no impurity particles present outside the isolator can enter the isolator and contaminate the bulk material.

Preferably, the docking portion comprises:

- a rigid plate portion against which a rigid rim of the container is pressed as intended, and
- a passage portion connected to the plate portion via a, preferably flexible, connecting element, which can be detachably connected to the opening element, which is fastened to a flexible inner container of the container as intended.

In particular, the plate portion comprises sealing means that interact with the rigid edge of the container during pressing in such a way that the opening element is completely enclosed. The container is in particular a drum in which the flexible inner container, for example a bag, is located. When the drum is docked as intended, its lid is removed first and the rim defining the resulting opening is pressed against the sealing means by lifting the drum.

The opening element is preferably attached to the flexible inner container before the rigid rim is lifted/pressed on. To subsequently connect the opening element to the passage portion, the opening element is inserted into the passage portion manually or automatically, for example, and the container is then lifted.

Alternatively, the robot device may be configured to grab and move the passage portion within the insulator in order to connect the passage portion to the opening element after the rigid rim has been pressed against the sealing means, for example to plug them together.

The opening element preferably has a frame portion, which is attached to the flexible inner container as intended, and a lid portion that closes the frame portion. After connecting the opening element with the passage portion, the passage portion holds the frame portion detachably.

The frame portion is attached to the flexible container using an adhesive film, for example, which is attached to the frame portion. Alternatively, the frame portion can be welded to the flexible container.

The adhesive foil preferably spans a passage channel defined by the frame portion. In addition, the adhesive foil is preferably larger radially to the axis of the passage channel than the frame portion, so that the adhesive foil protrudes radially outwards.

When attaching the frame portion to the flexible inner container, the user presses the adhesive film against its outer surface, wherein the protruding part of the adhesive film flexibly adheres to the outer surface of the inner container.

The lid portion is connected to the frame portion in a force-locking or interlocking manner so that the robot device can actuate or release the lid portion to provide access.

For example, the lid portion is snapped into the frame portion or engages with it in a force-locking manner. Alternatively, or additionally, the frame portion and lid portion can be detachably attached to each other via a bayonet catch.

The connecting portion connects the plate section and the passage portion. The connecting portion can be stiff/rigid or flexible.

In the latter case, the connecting portion is preferably flexible in such a way that the passage portion can be moved in space relative to the plate portion—manually by the user or by the robot device. The purpose of this flexibility is to provide clearance in order to be able to connect the passage portion to the opening element, in particular to be able to compensate for different filling heights of the flexible inner container or an offset between the passage portion and the opening element.

The flexible connecting element is tubular or funnel-shaped, for example, and runs coaxially to the passage channel of the frame portion.

Preferably, the explained device further comprises:

a closure which closes the passage portion and comprises an engaging portion, wherein the robot device is configured to grab the closure at the engaging portion to open the passage portion.

The closure closes the passage portion in such a way that the robot device is completely enclosed in the isolator and residual quantities of the bulk material cannot escape through the passage portion to the outside.

The closure closes the passage portion, particularly in the situation in which no container is docked.

The engaging portion is, for example, a pin that protrudes from the closure into an interior space of the insulator and on which the robot device can grab the closure.

Preferably, the closure has structures that interlock with the lid portion of the opening element when the container is docked.

The interlocking of the closure with the lid portion means that when the robot device grabs and removes the closure to open it, it simultaneously actuates or removes the lid portion of the opening element and thus gains access to the interior of the container or inner container.

The structures of the closure are formed, for example, by the spigot having an axial cavity and the lid portion having a corresponding plug-in spigot, which is inserted into the cavity of the spigot when the container is docked and is force-locked there.

Preferably, the device is further designed in such a way that the passage portion has a sealing device which is arranged to hold the closure and the opening element independently of one another in a releasable manner, wherein the robot device, after the passage portion is connected to the opening element via the sealing device, is preferably configured to operate the closure and the opening element in such a way that the robot device has access to the interior space within the flexible inner container of the container via the opening element.

The independent mounting of the closure and the opening element allows the closure to remain in place while the container is being changed.

Preferably the sealing device comprises an inflatable seal and a further seal, which is preferably a further inflatable seal and is arranged offset to the inflatable seal in the passage portion, and the inflatable seal is arranged to releasably retain the closure, and the further seal is arranged to releasably retain the opening element for connection to the container.

The further seal holds the opening element, in particular by acting on the frame portion, wherein the lid portion can be removed after or together with the closure.

The invention additionally relates to an accessory for a device as described above, wherein the accessory comprises the closure and the opening element.

Below, a preferred embodiment of the invention is explained with reference to the attached figures.

FIGS. 1A and 1B show sectional views of a device according to the invention, which is used for at least partially filling and/or emptying a drum and is in an initial situation, wherein FIG. 1B shows the enlarged section 1A shown in FIG. 1A.

FIGS. 2A and 2B show sectional views of the device according to the invention, which is in a situation in which an opening element of the container is connected to a passage portion, wherein FIG. 2B shows the enlarged section 2A shown in FIG. 2A.

FIG. 3B shows the enlarged section 3A shown in FIG. 3A.

FIG. 4B shows the enlarged section 4A shown in FIG. 4A.

FIG. 1 shows an embodiment of a device 1 for handling containers according to the invention. The device 1 is used in particular for emptying containers containing a bulk material and/or for filling the containers with a bulk material.

Figure 1A:
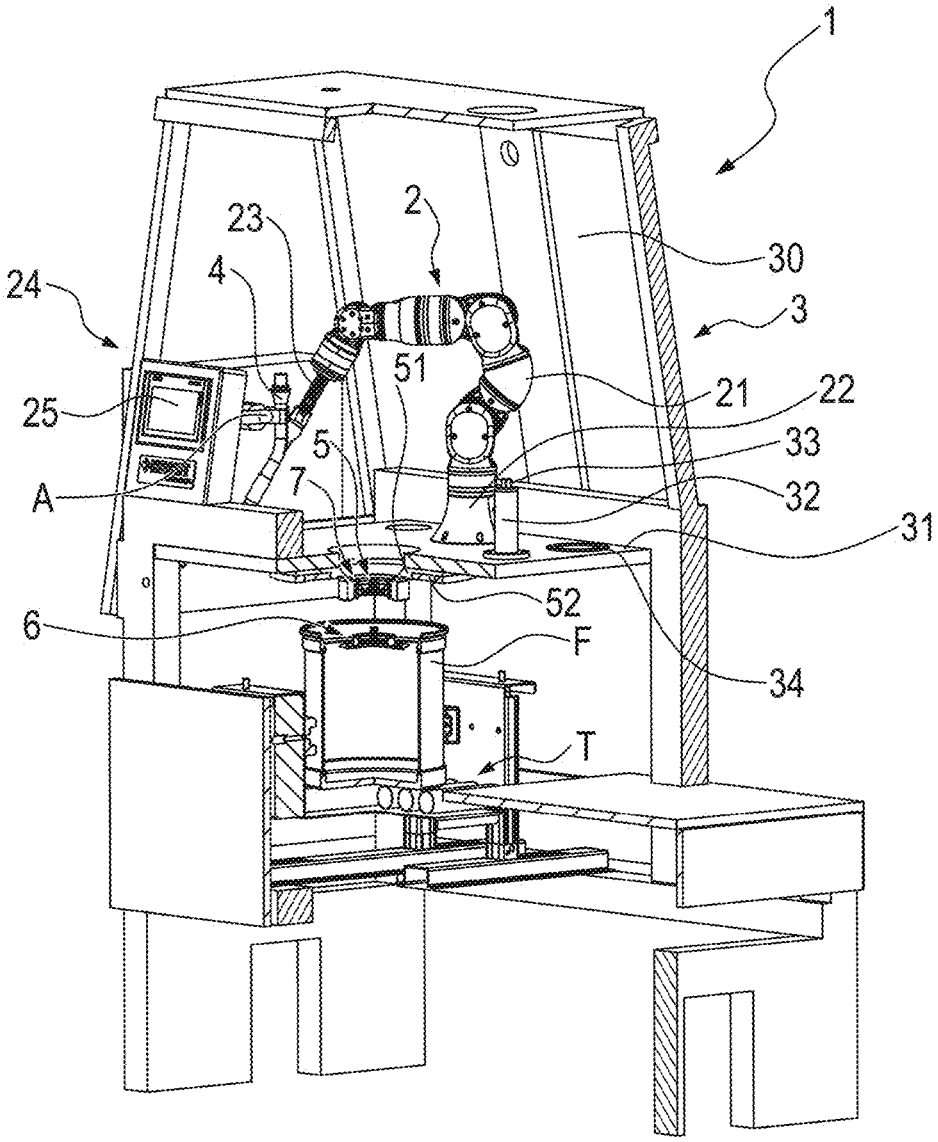

The containers are preferably drums F, which have an additional inner container, such as an inner bag enclosing the bulk material.

The device 1 preferably includes a robot device 2 which, as will be explained in detail below, can actuate an opening element 6 in order to gain access to the drum F or to the inner bag.

The robot device 2 comprises a robot arm 21 with preferably six joints for performing movements in space and a base 22, via which the entire robot device 2 is attached to a table surface 31 of an isolator 3, which is explained below.

A gripper (effector) 23 is attached to a distal, free end of the robot arm 21 with respect to the base 22, which is used to grab different elements, as will be explained below, and to use or be deployed for emptying/filling the drum F.

In addition, the robot device 2 has a controller 24, which is connected to the robot arm 21 and the gripper 23 electrically or by radio. The controller 24 is configured to control the robot arm 21 and the gripper 23 in order to move to desired positions and carry out corresponding activities. The controller 24 can also be used to program the robot arm 21 and the gripper 23.

The device 1 according to the invention preferably has the insulator 3, which is completely closed and defines a sealed-off interior space 30. Preferably, the isolator 3 is constructed in such a way that a user can view the sealed-off interior space 30 via glass panes.

As already mentioned, the base 22 of the robot device 2 is attached to a table surface 31 of the isolator 3. In addition, a tool holder 32 for a cutting tool 33 and a parking position 34, which are explained below, are formed within the insulator 3 on the table surface 31.

A conveyor line 4, which is used to empty and/or fill the drum F, is arranged in the interior space 30 of the isolator 3 next to the robot device 2 and is suspended in a suspension A. The robot device 2 is in such close proximity to the suspension A that it can grab the conveyor line 4 with the gripper 23 and use it to empty and/or fill the drum F.

A pneumatic conveyor system (not shown) is arranged outside the isolator 3 and connected to the conveyor line 4 via a connection on the isolator 3. The pneumatic conveyor system is configured to pneumatically transport bulk material through the conveyor line 4 for emptying and/or filling the drum 4.

The device 1 according to the invention preferably also includes a transport device T, which is arranged below the insulator 3. The transport device T is configured to bring the drum F to be emptied and/or filled into a desired docking position in which it can be connected to the isolator 3. In particular, the transport device T is preferably configured to transport the drum F under the insulator 3 and then lift it.

The drum is preferably connected to the insulator 3 via a docking portion 5, which is arranged on an underside of the insulator 3 on a side facing away from the table surface 31.

The docking portion 5 and the drum F arranged below it are shown enlarged in FIG. 1B, whereby the corresponding elements are explained below with reference to this figure.

The docking portion 5 comprises a rigid plate portion 51, on which sealing means 52 are preferably provided. The plate portion 51 and preferably the corresponding sealing means 52 completely surround a passage portion 53. The sealing means 52 are preferably formed from an elastomer, for example rubber.

During the emptying and/or filling of the drum F, as explained below, the upper rim of the drum F is pressed against the sealing means 52.

A connecting element 54 connects the passage portion 53 mentioned and explained below with the plate portion 51. The connecting element 54 may be formed monolithically with the plate portion 51 and/or the passage portion 53, as shown, or may be a separate element attached to said portions. In addition, the connecting element 54 can be formed from a flexible material, for example an elastomer, or from a rigid material.

The connecting element 54 extends from the plate portion 51 in a funnel shape in the direction of the drum F, with the passage portion 53 being attached to the distal end of the connecting element 54 with respect to the insulator 3.

An accessory for the device 1 according to the invention comprises an opening element 6, which is intended to be attached to the inner container, the inner bag IS, of the drum F and serves to connect with the passage portion 53.

The opening element 6 includes a frame portion 61 which is attached to the inner bag IS. This attachment is preferably made by means of an adhesive film 62 which is attached to the frame portion 61 and which is pressed onto an outer surface of the inner bag IS. Alternatively, the frame portion 61 may be welded to the inner bag IS. The frame portion 61 defines a passage channel 63 with a channel axis KA, wherein the adhesive film 62 preferably completely spans the passage channel 63 and thus completely closes the passage channel 63 on the side facing the inner bag IS.

The frame portion 61 extends axially to the channel axis KA in a tubular shape (hollow cylinder) and preferably includes a flange portion 64 extending radially to the channel axis KA, on the side of which facing the drum F the adhesive film 62 is attached. Preferably, the adhesive foil 62 protrudes radially over the flange portion 64 in relation to the channel axis KA.

To attach the opening element 6 to the inner bag IS, a user manually presses the adhesive film 62 with its adhesive side against the outer surface of the inner bag IS. This process can also be automated, for example by an external robot attaching (gluing or welding) the opening element 6 to the inner bag IS. A lid that may have previously been on the rim R of the drum F is removed in advance. This can be done either manually by the user or automatically, for example by the external robot.

The opening element 6 also has a lid portion 65, which closes one end of the frame portion 61 facing the insulator 3 or the passage portion 53. The lid portion 65 preferably holds onto the frame portion 61 in a force-fit and/or form-fit manner.

On its side facing the through portion 53 or the insulator 3, the lid portion 65 comprises a plug-in pin 66 which, as explained below, serves to connect it to the passage portion 53 or the insulator 3.

Overall, the opening element 6, in particular the frame portion 61 and the lid portion 65 with its plug-in pin 66, is made of a plastic material.

The device 1 further comprises a closure 7.

The closure 7 is preferably inserted into the passage portion 53 (see FIG. 1B) in such a way that a corresponding passage channel of the passage portion 53 is closed.

The closure 7 has a pin 71 which protrudes into the interior of the insulator 3 and has a rectangular cross-section, for example perpendicular to the channel axis KA of the passage channel of the passage portion 53. The pin 71 forms a gripping section at which the robot device 2 grabs the closure 7 in order to open the passage portion 53, as will be explained below.

The pin 71 is axially hollow or has an axially extending cavity 72, which serves to connect it to the opening element 6.

The passage portion (53) preferably comprises a sealing device which is configured to hold the closure 7 and the opening element 6 independently of one another in a releasable manner. In particular, the sealing device has an inflatable seal 531 and a further seal 532, which is preferably also an inflatable seal. A compressed air line for supplying the inflatable seals 531 and 532 preferably runs through the connecting portion 54 or as a separate line outside the connecting portion 54 to the passage portion 53.

The inflatable seal 531 is configured to hold the closure 7 in a releasable manner. When the closure 7 is inserted into the passage channel of the passage portion 53 (FIG. 1B), the inflatable seal 531 holds the closure 7 in a force-locking manner by the controller expanding the inflatable seal 531 by introducing compressed air and pressing it against an outer surface of the closure 7 pointing in the radial direction.

To release the closure 7, the controller contracts the inflatable seal 531 by discharging the compressed air it contains.

The further seal or further inflatable seal 532 is used for the connection with the opening element 6, which is described below.

With reference to FIGS. 2A, 2B to 6A, 6B, the functions of the device 1 according to the invention are described.

Figure 1B:
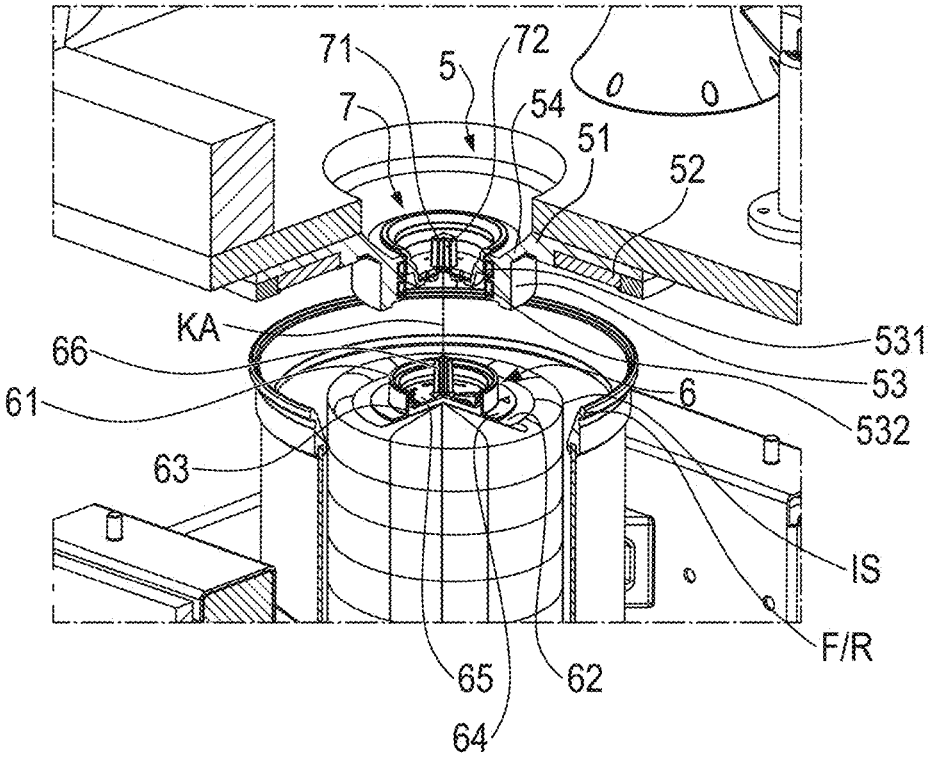

The initial situation is shown in FIGS. 1A and 1B, where the transport device T has brought the drum into the position shown. The lid of the drum has already been removed so that the opening element 6 is located below the docking portion 5.

Figure 2A:
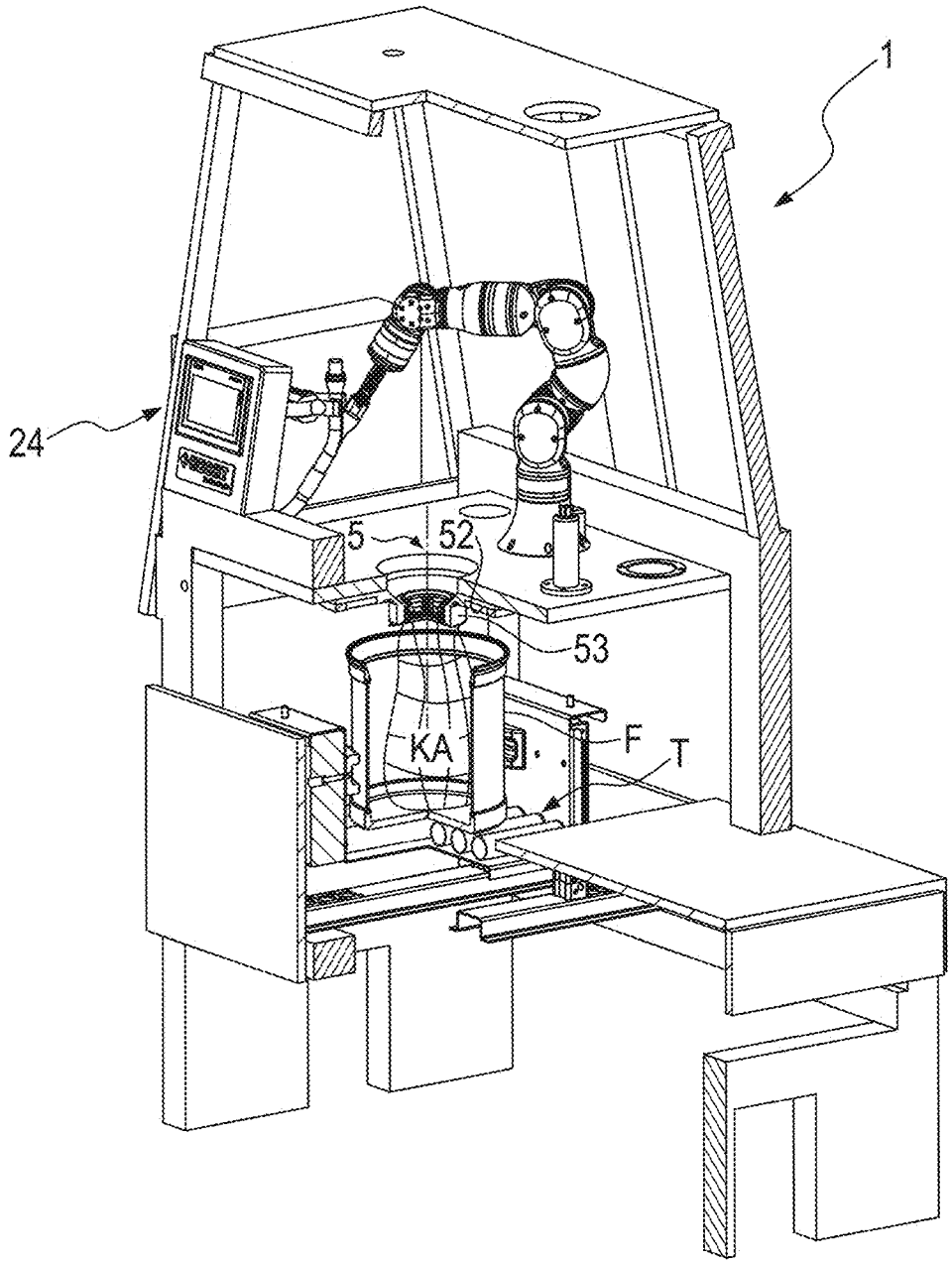
Figure 2B:
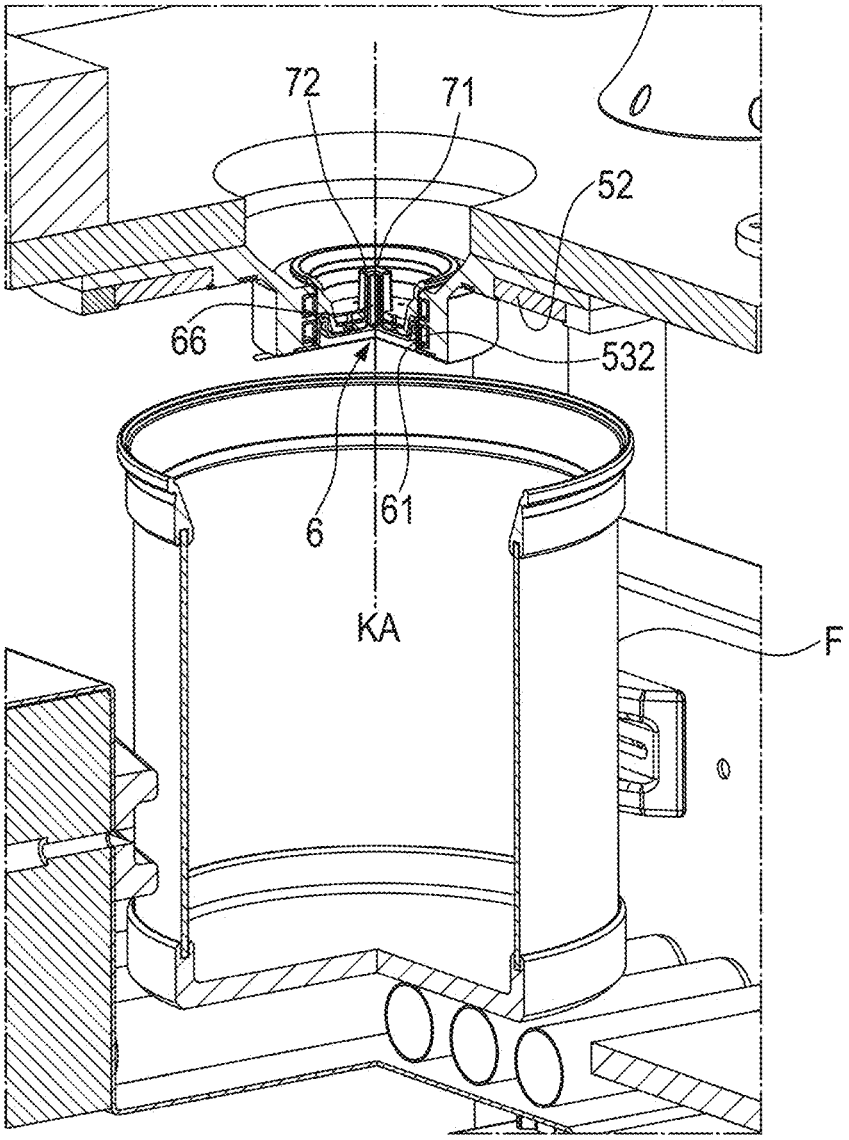

The user can now lift the opening element 6 and insert it into the passage portion 53. This process can also be automated, for example by the external robot device. FIGS. 2A and 2B show the state achieved.

In this process, the plug-in pin 66 of the lid portion 65 of the opening element 6 is inserted into the axial cavity 72 of the pin 71. The controller then expands the inflatable seal 532, which then presses radially to the channel axis KA of the passage portion 53 against the outer surface of the frame portion 61 pointing in the radial direction, thus holding the opening element 6 stationary.

The controller 24 now lifts the drum F by means of the transport device T until the rim R is pressed against the sealing means 52. The opening element 6 connected to the passage section is thus completely enclosed.

Figure 3A:
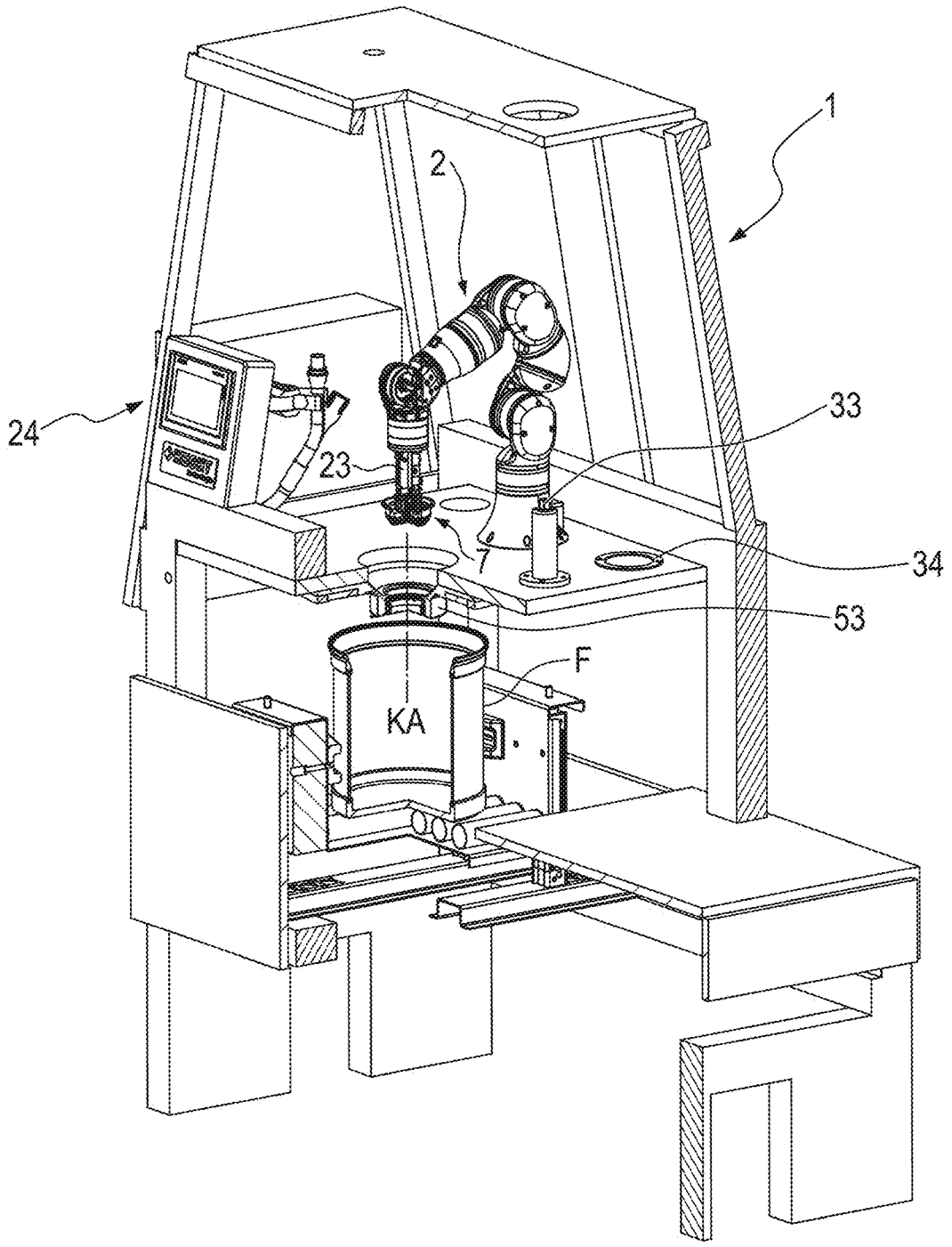
FIGS. 3A and 3B show sectional views of the device according to the invention, wherein a robot device removes a closure and a lid portion
Figure 3B:
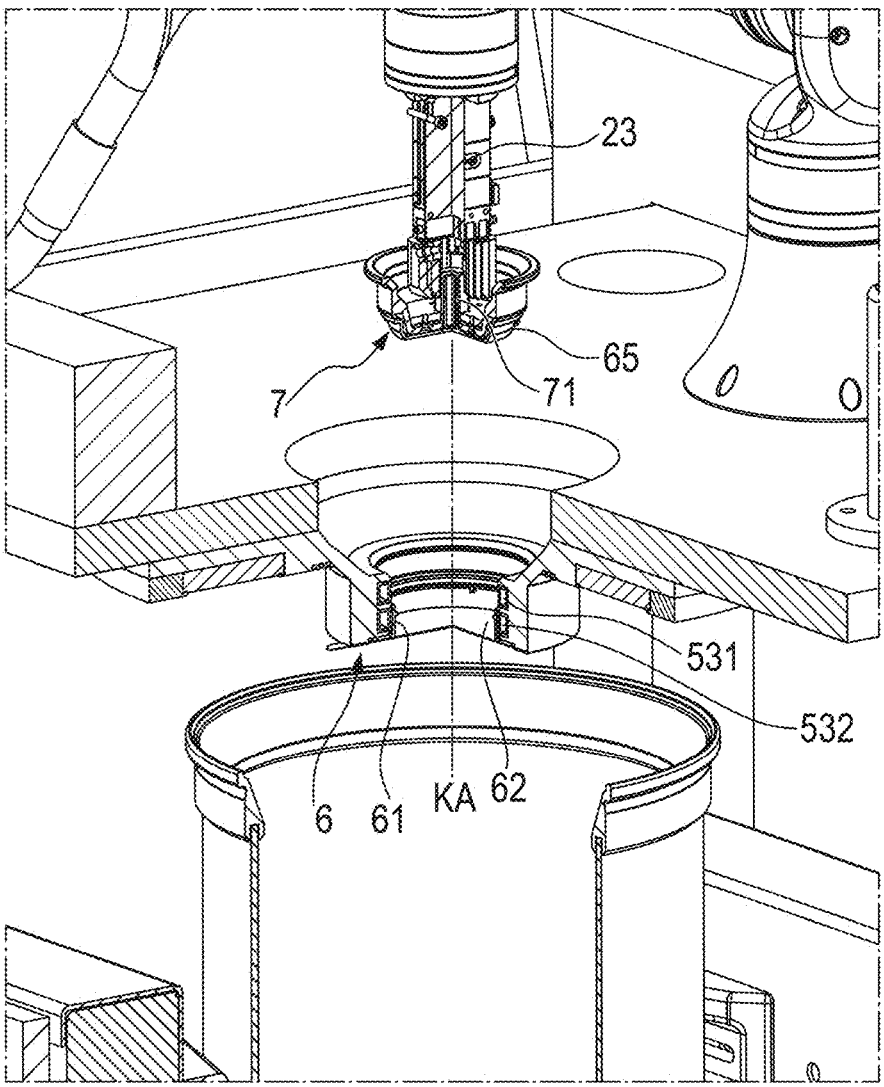

The function sequence then moves on to FIGS. 3A and 3B.

The controller 24 then controls the robot device 2 in such a way that the robot device 2 grabs the pin 71 of the closure 7 with its gripper 23 and removes the closure 7 from the passage portion 53. In particular, the robot device 2 pulls the closure 7 in the direction of the channel axis KA out of the passage channel of the passage portion 53. In order to do this, the controller 24 contracts the inflatable seal 531 in advance. The further inflatable seal 532 located axially below the inflatable seal 531 in the direction of the channel axis KA remains expanded and continues to hold the opening element 3 stationary.

Due to the fact that the plug-in pin 66 of the lid portion 65 is friction-locked in the cavity 72 of the pin 71, the robot device 2 removes the lid portion 65 of the opening element 6 together with the closure 7. It should be noted at this point that the inflatable seal 532 does not act on the lid portion 65, but only on the frame portion 61 when it holds the opening element 6 stationary.

The robot device 2 places the closure 7 together with the lid portion 65 in the parking position 34, which is formed in the table surface 31. The parking position can preferably be provided with an inflatable seal to protect the closure 7 together with the lid portion 65 from contamination.

The controller 24 then controls the robotic device 2 so that it grabs the cutting tool 33 with its gripper 23. The cutting tool 33 is only optional. Alternatively, the passage can already be open or the conveyor line 4 described below can be provided with a cutting element.

Figure 4A:
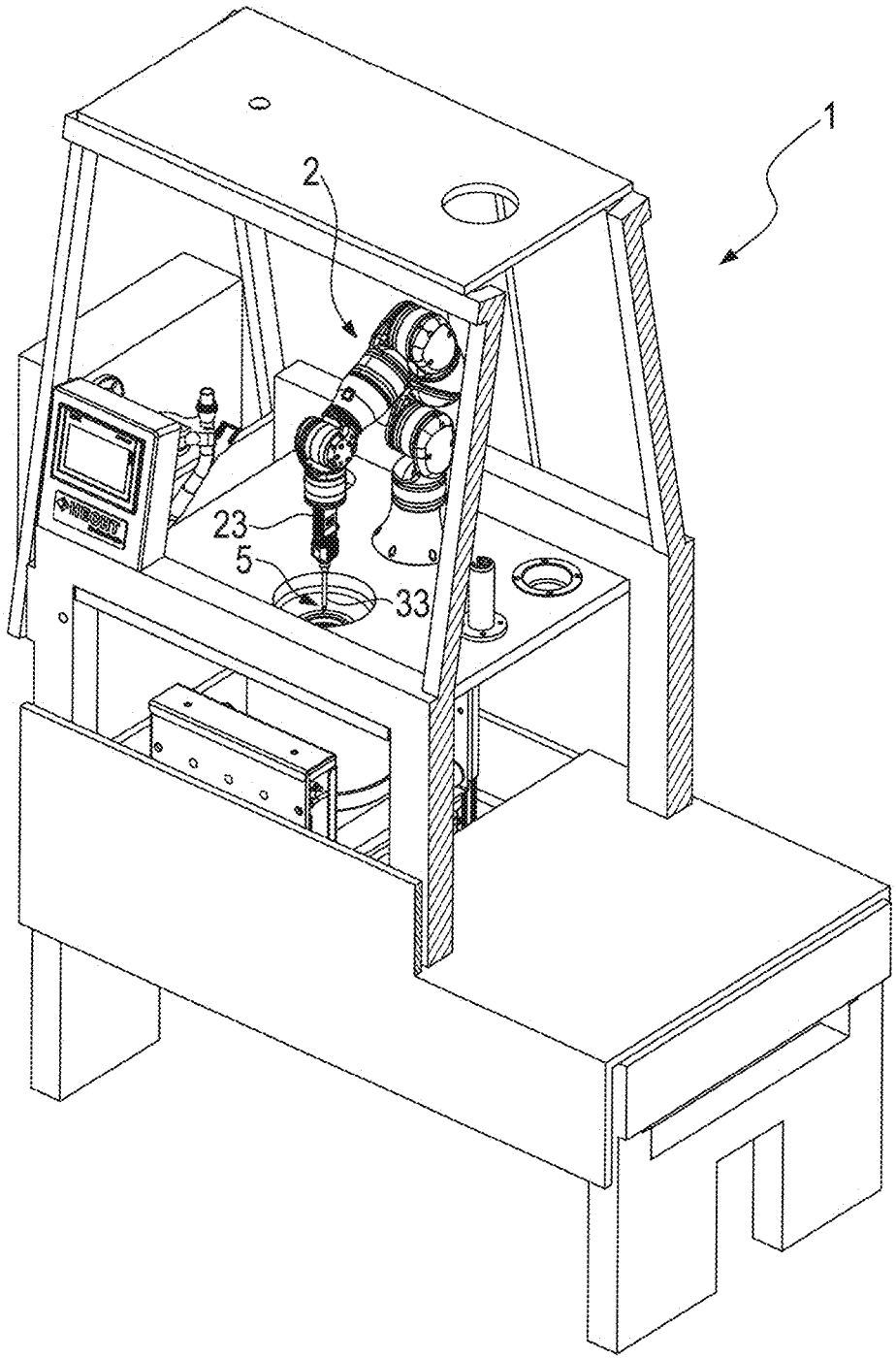
FIGS. 4A and 4B show sectional views of the device according to the invention, wherein the robot device uses a cutting tool
Figure 4B:
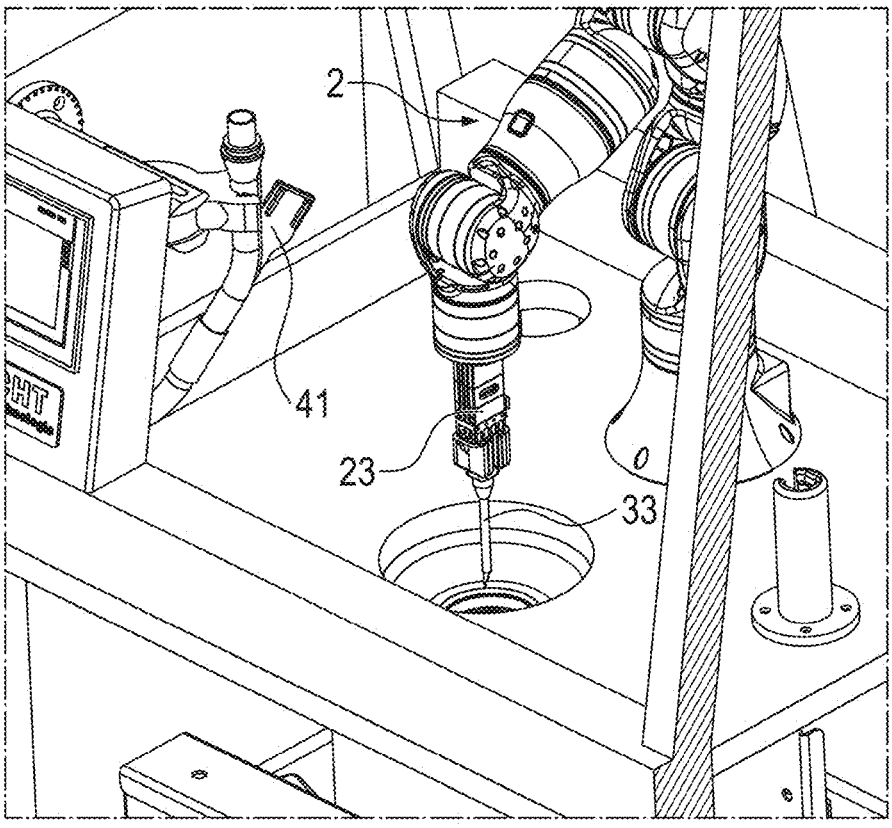

The function sequence is shown in FIGS. 4A and 4B below. The robot device 2 moves the cutting tool 33 over the docking portion 5 and from there into the passage portion 53.

The adhesive film 62 (see FIG. 3B) spanning the passage channel of the frame portion 61 adheres to the inner bag IS and closes the frame portion 61.

In order to gain access to an interior space of the inner bag IS, the robot device 2 cuts through the adhesive film 62 spanning the passage channel of the frame portion 61 with the cutting tool 33. At the same time, the robot device 2 cuts through the inner bag IS attached underneath, so that the interior space of the inner bag IS is accessible to the robot device.

The robot device 2 then places the cutting tool 33 back in the tool holder.

Preferably, the docking portion 5 can be designed in such a way that a vacuum is generated in a space between the drum F and the flexible inner bag IS, which pulls the inner bag IS against the drum.

Figure 5A:
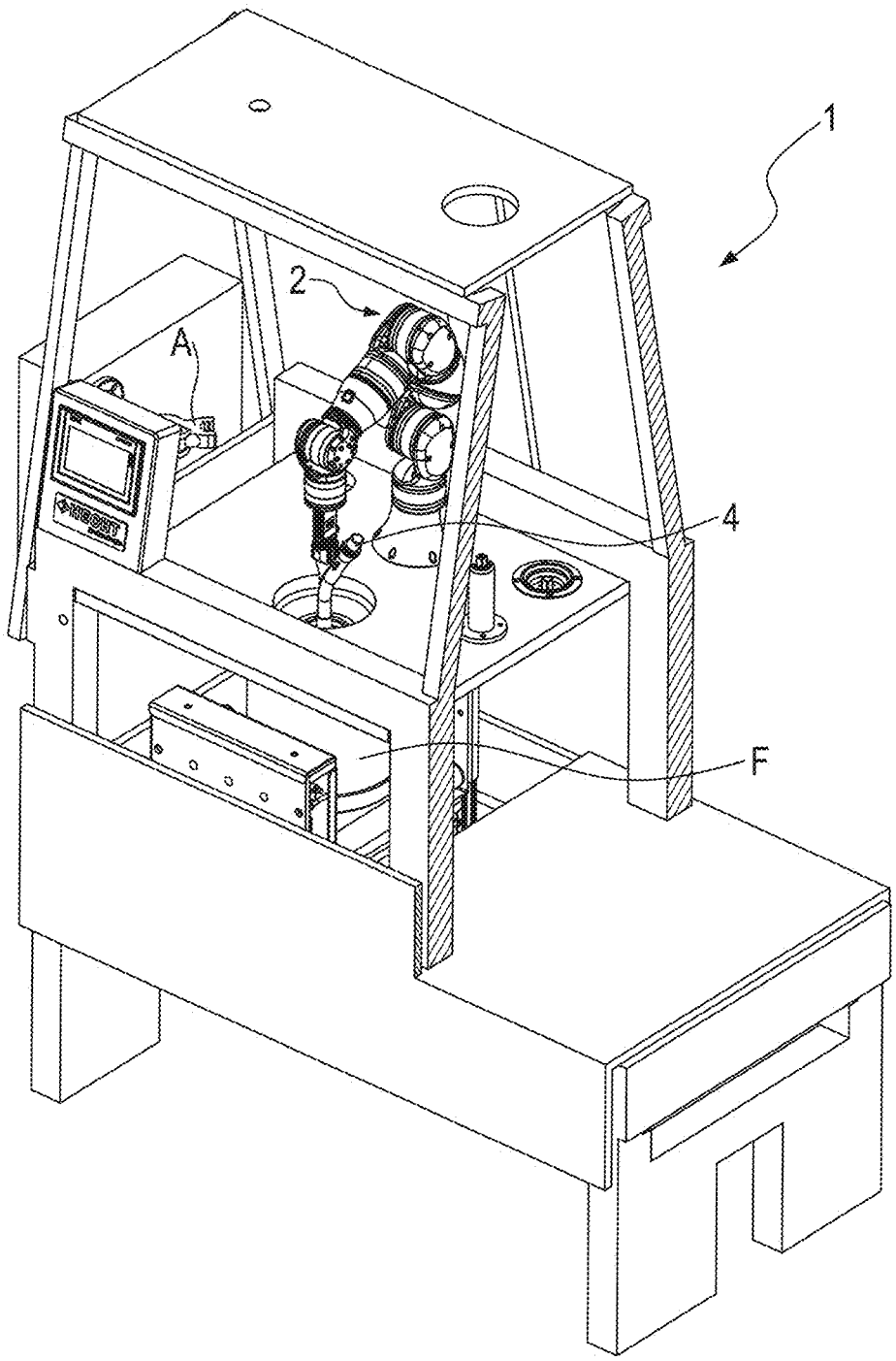
FIGS. 5A and 5B show sectional views of the device according to the invention, with the robot device grabbing and inserting a conveyor line in order to empty the docked drum.
Figure 5B:
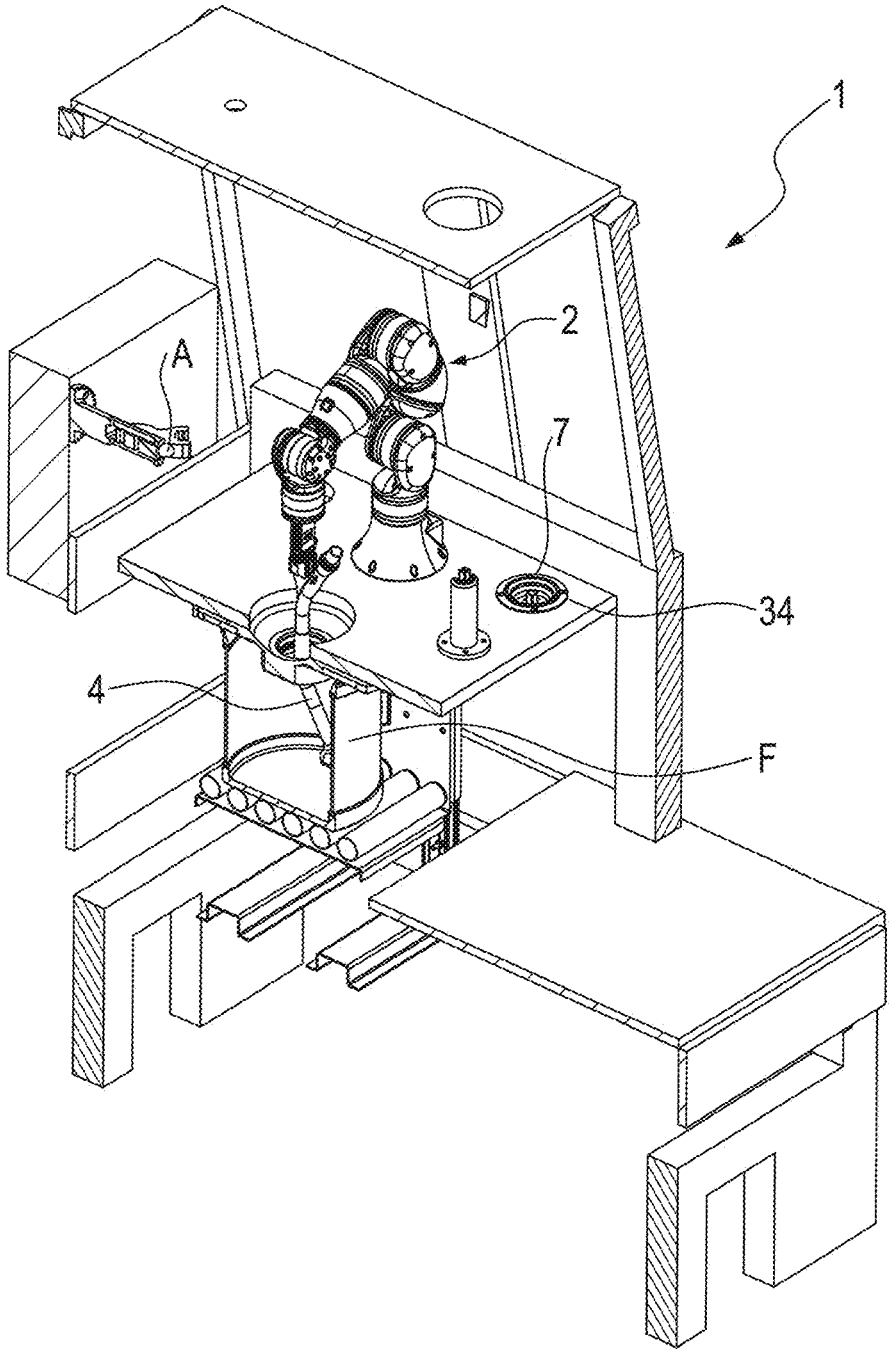

The function call sequence now moves on to FIGS. 5A and 5B. The robot device 2 grabs the conveyor line 4 at a gripping projection 41 and releases it from the suspension A. For the sake of good order, it should be mentioned that not the complete conveyor line 4 is shown in the figures, but only the portion that is inserted into the interior of the inner bag IS.

As can be seen in FIGS. 5A and 5B, the robot device 2 feeds the conveyor line 4 into the interior of the inner bag IS until it reaches the bottom of the drum F. The invention is not limited to this. The robot device 2 inserts the conveyor line 4 as far into the interior of the inner bag as necessary.

Subsequently, a bulk material (not shown) present in the drum or in the interior space of the inner bag can be removed pneumatically conveyed (emptying of the drum F) or pneumatically conveyed into the interior space of the inner bag IS (filling of the drum F).

Figure 6A:
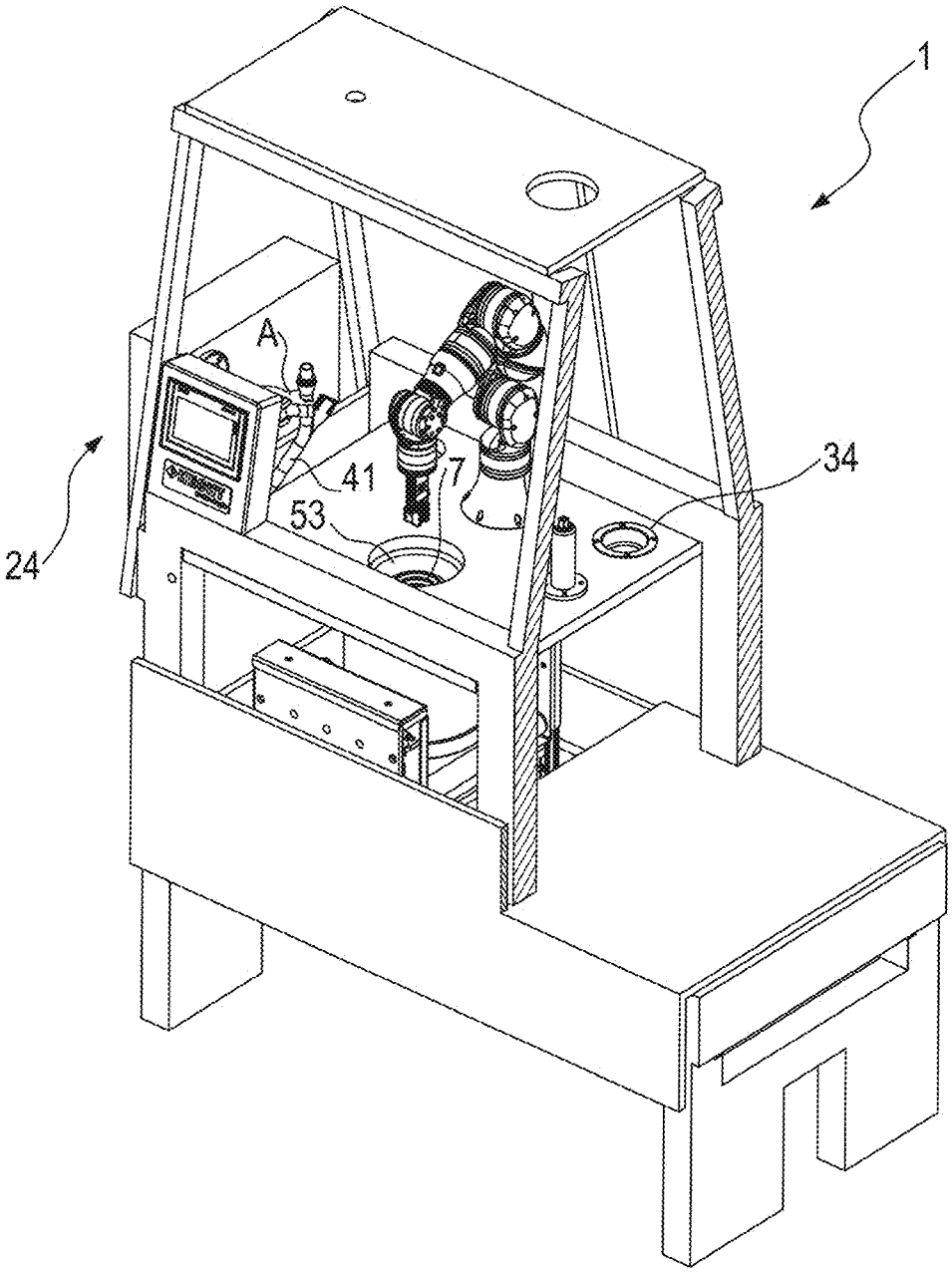
FIGS. 6A and 6B show views of the device according to the invention, whereby the robot device has closed the passage portion again with a lid portion and a closure after emptying the drum.
Figure 6B:
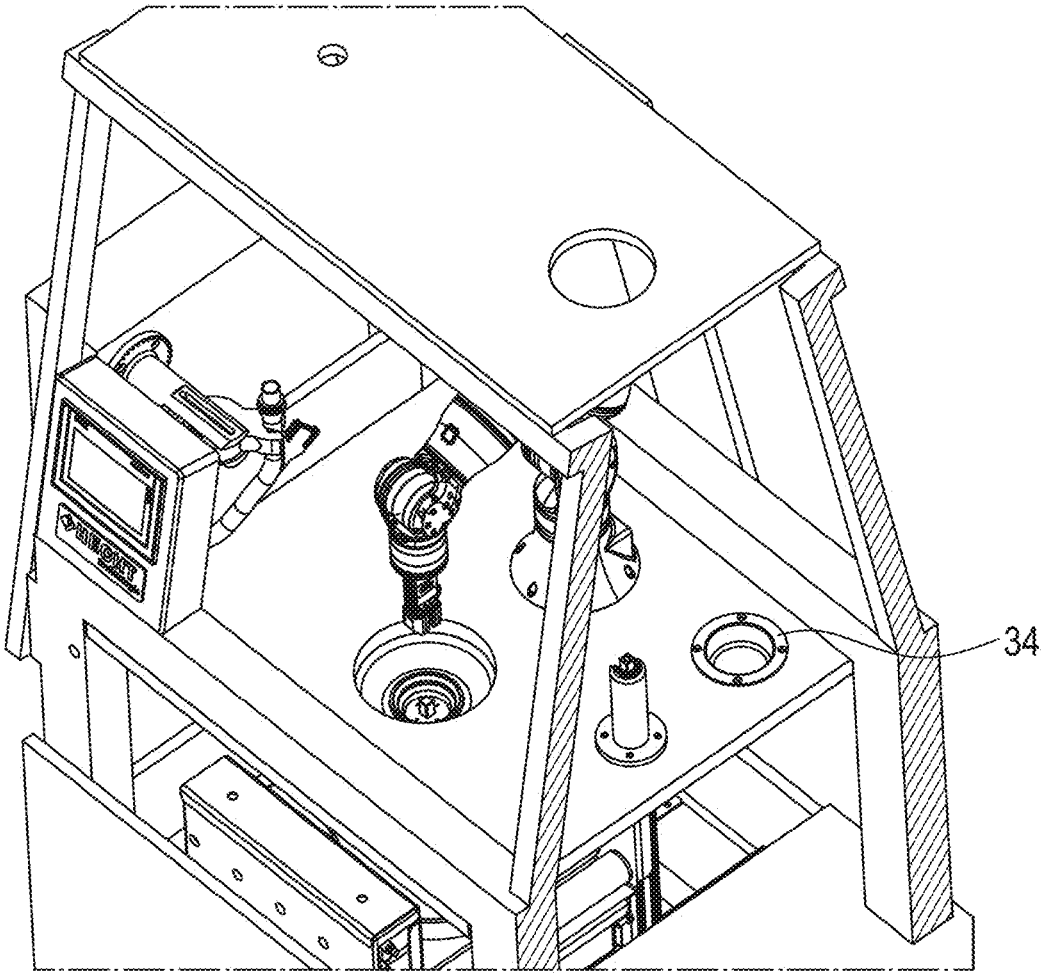

When this process is complete, the function sequence moves on to FIGS. 6A and 6B.

The robot device 2 hangs the conveyor line 4 back into the suspension A and then grabs the closure 7, which is in the parking position 34.

In order to be able to release the opening element 6 again, the robot device 2 places the closure 7 together with the lid portion 65 inserted therein back into the passage portion 53, wherein the state shown in FIGS. 2A and 2B is achieved. The controller 24 then activates the inflatable seal 531 to secure the closure 7 in the passage portion 53.

The vacuum preferably generated in the intermediate space is now switched off.

The controller 24 now finally contracts the inflatable seal 532, wherein the frame portion 61 of the opening element 6 can be released from the passage portion 53 and at the same time the plug-in pin 66 can be released from the cavity 72 of the pin 71.

The function sequence now reaches the state shown in FIGS. 1A and 1B.

The drum F to be handled can now be changed.

It should be mentioned that an outer surface of the cover portion 65, on which the plug-in pin 66 is formed, is at no time exposed or exposed in the interior of the insulator 3. This is due to the fact that the plug-in pin 66 is inserted into the cavity 72 to such an extent that the outer surface of the lid portion 65 is brought into contact with an outward-facing surface of the closure 7. Preferably, this effect can be further enhanced by arranging a seal between the lid portion 65 and the closure 7.

As a result, bulk material is prevented from accumulating on the outer surface of the lid portion 65 and being distributed in an external environment of the insulator 3 after the opening element 6 is released.

It should also be mentioned that the lid portion 65 can be locked to the frame portion 61, for example by means of a bayonet catch. In other words, in the state shown in FIGS. 2A and 2B, in which the plug-in pin 66 is located in the cavity 72, the robot device 2 first rotates the lid portion 65 indirectly via the pin 71 and can then remove the closure 7 together with the lid portion 65, as explained with reference to FIGS. 3A and 3B.

It should also be emphasized that the handling of the drum F by the robot device 2 is completely contamination-free.

The explanations before the description of the figures apply equally to the description of the embodiments and vice versa.

The invention claimed is:

1. Device for handling containers:

a robot device configured to operate an opening element provided on/in a container in such a way that the robot device has access to an interior space of the container via the opening element, and to subsequently fill and/or empty the container via the opening element, wherein a docking portion comprises:

a rigid plate portion against which a rigid rim of the container is pressed as intended, and a passage portion connected to the rigid plate portion via a flexible connecting element, wherein the passage portion is configured to be detachably connectable to the opening element, wherein the opening element is fastened to a flexible inner container of the container as intended, and wherein the robot device is configured to operate the opening element through the flexible connecting element and through the passage portion when the passage portion and the opening element are connected.

2. The device according in claim 1, further comprising:

an isolator in which the robot device is arranged and to which the container can be connected via the docking portion in such a way that the opening element is accessible to the robot device.

3. The device according in claim 1, further comprising:

a closure which closes the passage portion and comprises an engaging portion, wherein the robot device is configured to grab the closure at the engaging portion to open the passage portion.

4. The device according to claim 3, wherein the passage portion comprises a sealing device which is configured to hold the closure and the opening element independently of one another in a releasable manner, the robot device, after the passage portion is connected to the opening element via the sealing device, is configured to operate the closure and the opening element in such a way that the robot device has access to the interior space within the flexible inner container of the container via the opening element.

5. The device according to claim 4, wherein the sealing device comprises an inflatable seal and a further seal, which is a further inflatable seal and is arranged offset to the inflatable seal in the passage portion, and the inflatable seal is arranged to releasably retain the closure, and the further seal is arranged to releasably retain the opening element for connection to the container.

6. The device according to claim 5, wherein the robot device is configured to operate the closure and the opening element together.

7. An accessory and the device according to claim 1, comprising:

a combination of the opening element and a closure, wherein the closure closes the passage portion as intended and has an engaging portion for the robot device, and the opening element comprises a frame portion which is fastened to a flexible container as intended and a lid portion which closes the frame portion and has an engaging portion for the robot device, wherein the engaging portion of the closure and the engaging portion of the opening element engage releasably with one another.

* * * * *